United States Patent [19]

Gonçalves

[11] Patent Number: 4,664,299

[45] Date of Patent: May 12, 1987

[54] ASSEMBLY FOR DISPENSING DOSES OF A SUBSTANCE OF A LIQUID OR PASTY CONSISTENCY

[75] Inventor: Antonin L. Gonçalves, Groslay, France

[73] Assignee: L'Oreal, Paris, France

[21] Appl. No.: 694,623

[22] Filed: Jan. 24, 1985

[30] Foreign Application Priority Data

Jan. 27, 1984 [FR] France ..... 84 01285

[51] Int. Cl.[4] ..... B65D 85/72

[52] U.S. Cl. ..... 222/327; 222/80; 222/340; 222/378; 222/386

[58] Field of Search ..... 222/386, 386.5, 326, 222/327, 378, 80, 340, 402.12; 604/218, 227, 228

[56] References Cited

U.S. PATENT DOCUMENTS

| | | | |
|---|---|---|---|
| 1,638,456 | 8/1927 | Pike | 222/378 X |
| 2,646,906 | 7/1953 | Jones et al. | 222/327 X |
| 2,768,768 | 10/1956 | Cornell et al. | 222/80 |
| 3,484,023 | 12/1969 | Meshberg | 222/402.12 X |
| 3,815,791 | 6/1974 | Clark | 222/326 |
| 4,090,639 | 5/1978 | Campbell et al. | 222/326 X |
| 4,185,628 | 1/1980 | Kopfer | 222/386 X |
| 4,323,177 | 4/1982 | Nielsen | 222/386 |
| 4,331,267 | 5/1982 | Duncan et al. | 222/327 X |
| 4,339,058 | 7/1982 | Wendt | 222/326 X |
| 4,373,646 | 2/1983 | MacEwen | 222/386 X |

*Primary Examiner*—H. Grant Skaggs
*Assistant Examiner*—Edward S. Ammeen
*Attorney, Agent, or Firm*—Cushman, Darby & Cushman

[57] ABSTRACT

A dispenser comprises a container having a movable wall in the form of a plunger and an opposite fixed wall opening into a dispensing nozzle. Dispensing is actuated by a fixed dispenser mechanism having an operating rod with a pusher plate. The pusher plate is biased in the retraction direction by a spring, and a bayonet coupling is provided for holding a base portion of the container in relation to a socket of the dispenser mechanism.

5 Claims, 4 Drawing Figures

ASSEMBLY FOR DISPENSING DOSES OF A SUBSTANCE OF A LIQUID OR PASTY CONSISTENCY

The present invention relates to an assembly for dispensing doses of a substance of liquid or pasty consistency, intended to be applied in controlled fashion, either dropwise or at a relatively low rate, for example for dispensing doses of hair-colouring products which the hairdresser must apply directly to hair, distributing them on the latter.

These hair-colouring products are sold in bottles or tubes, each containing a dose necessary for an application to hair, this dose being approximately 15 $cm^3$. After the dose has been used, the container which held it is discarded. In the particular application considered it is difficult to avoid having to rely on an uneconomical dispensing method employing unit packages because the products in question must on no account be allowed to be able to oxidize before application. Under these conditions, the use of bottles or tubes each containing several doses cannot be considered since on each application the substance would be capable of coming into contact with air and, even when it does so for a short time, this may be sufficient to make the remaining doses useless. Furthermore, it is difficult to envisage a device for dispensing doses from a storage container because here too the disadvantage just mentioned is again to be found.

Moreover, a disadvantage which can be mentioned is that the unit containers referred to above are not particularly easy to use.

The Applicant Company has investigated another method of dispensing this type of product according to which a saving is obtained over the unit packages of the conventional dispensing method, this new dispensing method providing the user, that is to say the hairdresser, with greater ease of utilization.

The invention aims to provide a container which can be discarded after use and contains a dose of product and can be fitted onto a dispenser mechanism, such a container being capable of being produced by a process employing a multi-cavity mould, at a cost lower than the conventional tubes usually made of polyvinyl chloride, by injection moulding or by blow-extrusion, or lower than the usual glass bottles. In fact, the container according to the invention has no bottom, the dose which it contains being enclosed in the space bounded by its side wall, its end wall having an orifice for dispensing the product, and a plunger movable by virtue of an operating rod. The operating rod forms the moving part of the abovementioned dispenser mechanism whose fixed part on the one hand receives each container with a view to dispensing the dose which it holds and, on the other hand, advantageously guides the operating rod during the dispensing.

The present invention therefore provides a dispenser for a dose of a substance having a liquid or pasty consistency, comprising: firstly, a container defining a storage chamber for the substance to be dispensed, said storage chamber being bounded by a sleeve forming the side wall of the container, a plunger sealingly movable axially along the sleeve and an end wall closing one end of said sleeve, the end wall incorporating a discharge orifice for the delivery of the substance from the storage chamber, means being provided for restricting the movement of the plunger in the direction away from said end wall; and secondly, a dispenser mechanism incorporating a fixed part which is capable of removably receiving the container and a movable part supported by the said fixed part and consisting of an operating rod having a first end which co-operates with the plunger of the associated container, and actuating means for said operating rod permitting translational movement of the rod relative to the fixed part, and means for biasing the operating rod of the movable part of the dispenser mechanism resiliently in the direction of withdrawal of its first end from the storage chamber, the fixed and movable parts of the dispenser mechanism including co-operable means for removably connecting the container to the dispenser mechanism.

In a preferred embodiment of the present invention, the means for restricting the movement of the plunger of the container in the direction away from said end wall consists of a closing wall applied in a leaktight manner to the open end of the sleeve, said closing wall being capable of being penetrated by the operating rod with a view to operating the plunger of the container.

In a preferred embodiment, the dispenser mechanism comprises a fixed plate supporting the operating rod and arranged at right angles to the axis of the said rod and provided with an orifice for the passage of the rod, the said plate restricting the movement of the rod in the direction opposite the operating direction of the plunger.

In a particular embodiment, the dispenser mechanism comprises a fixed socket capable of receiving each container by its end opposite its discharge orifice, the assembly of each container with the dispenser mechanism being carried out by means of a bayonet coupling.

In particular, the bottom of a cylindrical base which is fitted against the open end of the sleeve forms at least one member of the closing wall which closes the said sleeve, this bottom incorporating an orifice for the passage of the operating rod, the cylindrical side wall of the said base carrying externally the pins of the bayonet coupling and its bottom carrying externally a resilient means coming to bear, when the container is assembled with the dispenser mechanism, on said fixed plate of the dispenser mechanism, the said fixed plate being connected to one of the rims of the socket, and said socket incorporating catches which co-operate with the pins of the said base.

Advantageously the actuating means consists of a pusher plate arranged at one end of the operating rod.

Advantageously, the dispenser mechanism incorporates a fixed means for guiding the rod and the associated actuating means. In the abovementioned case where the dispenser mechanism incorporates a fixed plate supporting the operating rod, the guiding means advantageously consists of a skirt carried by the fixed plate of the dispenser mechanism, the said skirt incorporating a lengthwise slot facilitating operation of the rod actuating means.

According to other features of the present invention, the means for biasing the rod to its rest position consists of a spring which bears, on the one hand, on a fixed support of the dispenser mechanism and, on the other hand, on a support forming part of the rod; the container is provided with a removable stoppering cap capable of closing the discharge orifice; the discharge orifice of the container is arranged at the end of a dispensing nozzle carried by the end wall of the sleeve, and the plunger of each container incorporates a cavity capable of receiving the first end of the operating rod.

Furthermore, in the case where a closing wall is applied in a leakproof manner to the opening of the sleeve, to form the means restricting the movement of the plunger in the direction away from the outlet orifice, provision is advantageously made for this wall to incorporate a metal sheet sealed to the rim of the open end of the sleeve, the said sheet being capable of being punctured by the operating rod.

One embodiment of the dispenser device according to the present invention will be described in greater detail below, purely by way of indication and without implying any restriction, with reference to the attached drawings.

Figure 2:
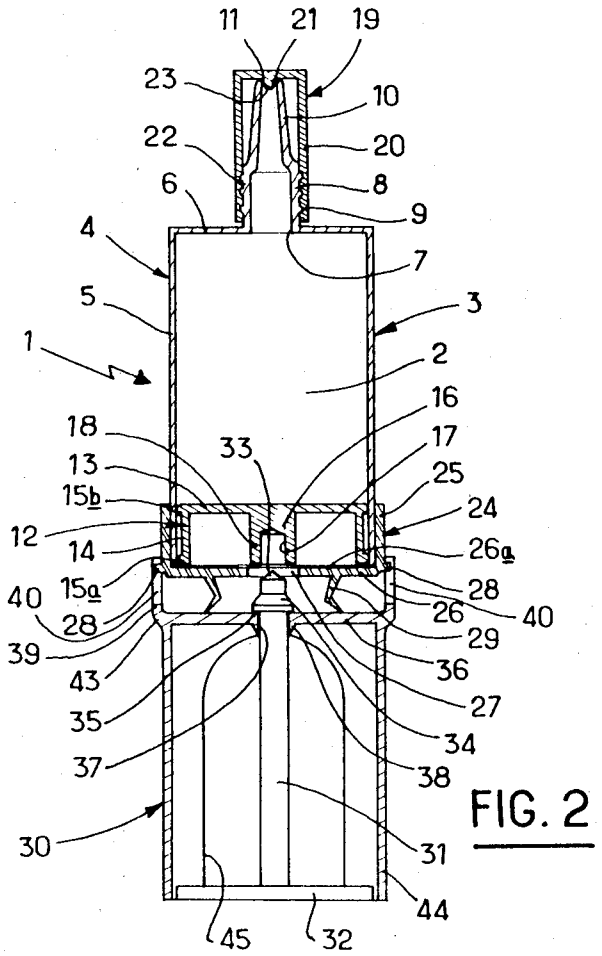
FIG. 2 is a view of the assembly of FIG. 1, in axial section along II—II of FIG. 4, the said assembly being shown in the position where the container holding the dose of product is simply engaged in the dispenser mechanism with a view to its being assembled onto the latter.

When reference is made to the drawing it can be seen that 1 refers to an assembly which makes it possible to dispense successively doses of a hair-colouring product having the consistency of a cream. Each dose is held in the storage chamber 2 of a disposable unit container 3 which can be seen in FIGS. 1 to 3 and is dispensed by a mechanism 30 receiving the unit containers 3 one by one.

Each container 3 incorporates a body 4 consisting of a cylindrical sleeve 5, one end of which is enclosed by a wall 6 provided with a central circular opening 7, surrounded externally by a cylindrical funnel 8, the axis of which coincides with that of sleeve 5, this funnel 8 having an external threading 9 and being extended by a frustoconical terminal 10, which converges in the direction away from the funnel 8 and which terminates at a nozzle provided with a central perforation 11, the axis of which coincides with that of the opening 7.

The storage chamber 2 inside the sleeve 5 is bounded by the end wall 6 and a plunger 12 capable of moving in a leakproof manner axially along the sleeve 5.

Plunger 12 consists of a circular plate or disc 13 with a right-angle bend at its periphery so as to form a side skirt 14 carrying externally two annular sealing flanges (15*a*, 15*b*), one (15*a*) situated at its free end, the other (15*b*) situated in the plane of disc 13. The tray has on the same side as the peripheral skirt 14, a cylindrical central stud 16 the axis of which coincides with that of the said skirt 14, this stud 16 having a central cavity 17 surrounded by a short skirt 18 coaxial with the skirt 14. In the assembled position of plunger 12 inside sleeve 5, the disc 13 is on the side of the plunger which faces the end wall 6 of the sleeve 5. Furthermore, before dispensing the plunger 12 is arranged in the sleeve 5 so that the flange 15*a* is applied against the inner wall of sleeve 5 close to the free rim of the said sleeve 5.

Each container 3 is provided with a removable stoppering cap 19 capable of closing the outlet orifice 11. Cap 19 consists of a cylindrical skirt 20 joined to a bottom 21. Skirt 20 carries internally, in the vicinity of its free edge, a thread 22 intended to cooperate with the outer threading 9 of container 3. In addition, the bottom 21 carries a central protruberance 23 intended to provide a leakproof closure by entering inside the orifice 11.

Furthermore, applied and fixed in a leakproof manner to the free end of the sleeve 5 is a base 24 consisting of a side skirt 25 joined to a bottom 26, the latter being provided with a central perforation 27. The skirt 25 which surrounds the sleeve 5 in the assembled position of base 24 on the sleeve carries externally two pins 28 arranged at 180° from each other and the bottom 26 incorporates a resilient circular lip 29 arranged towards the exterior of container 3. This resilient lip 29 is in the shape of an outwardly convergent cone curved at its free end so as to form an outwardly diverging frustum of a cone, the line joining the two conical frusta forming a bellows-type articulation.

In addition, the base 24 carries internally a flexible sealing wall in the form of a metal sheet 26*a*, for example of aluminium, initially unperforated as can be seen in FIG. 2, arranged against the inner wall of the bottom 26 of the said base 24. In the assembled position of base 24 on sleeve 5, the sheet 26*a* is sealed to the lower rim of sleeve 5 and thus forms an airtight seal protecting the substance perfectly against oxidation. Furthermore, sheet 26*a* and the bottom 26 of the base 24 form a closing wall restricting the movement of plunger 12 in the direction opposite the outlet orifice 11 of the container 3.

The dispenser mechanism 30 consists of a fixed part supporting a movable part formed by an operating rod 31 intended to cooperate with the plunger 12 of each container 3.

Figure 4:
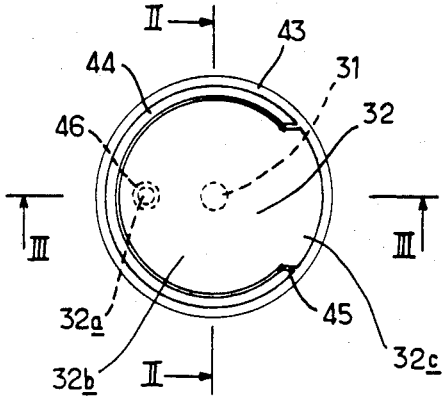
FIG. 4 is a bottom view along line IV—IV of FIG. 3.

Rod 31 carries, at one end, a pusher 32 consisting of a plate arranged in a plane at right angles to the axis of said rod 31. As can be seen in FIG. 4, plate 32 consists of a full circular disc 32*b* to the centre of which the rod 31 is connected, this disc 32*b* being extended in its plane, over a sector of approximately 80°, by an extension 32*c*, centred on the disc 32*b*. At its opposite end, rod 31 terminates in a point 33. At a small distance from the point 33, the rod has an external bulge 34 formed by an annular protruberance of its wall forming a bearing 35 remote from the pusher 32, the rod 31 having, starting from this bearing 34, over a short distance towards the point 33, a wider diameter which then becomes narrower to form a frustoconical part.

The fixed part of the dispenser mechanism 30 incorporates a circular plate 36 forming the support as such for rod 31. This plate 36 incorporates a central perforation 37 for the passage of rod 31, this perforation being edged on one side only by a lip 38.

Figure 1:
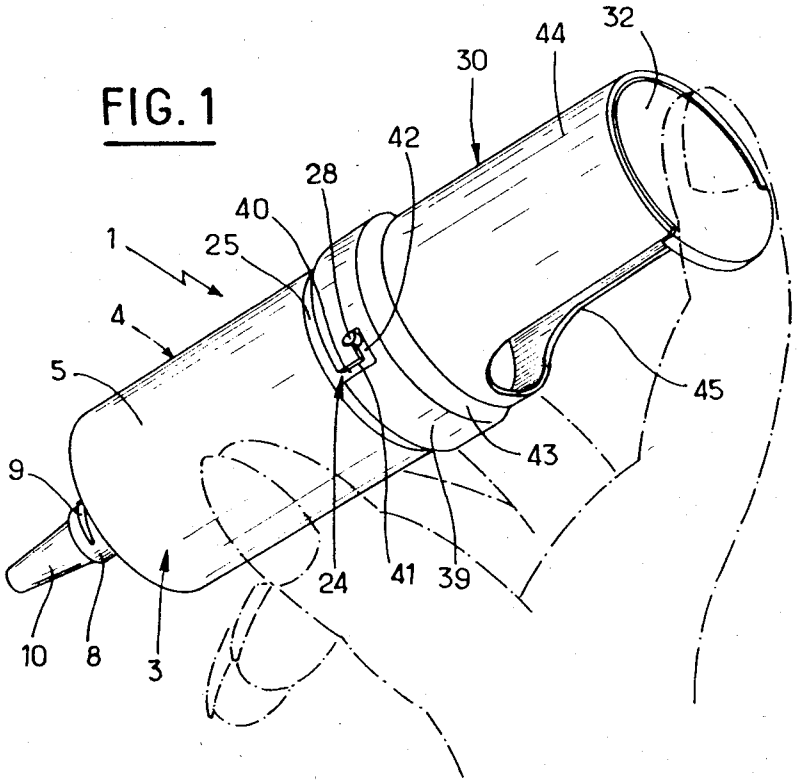
FIG. 1 shows a perspective view of the assembly according to the invention, in the starting position ready for applying a dose of product.

On the side opposite the lip 38, plate 36 carries a cylindrical shoulder in the form of an outer skirt 39 intended to form with the said plate 36 a socket capable of receiving each container 3 via its end remote from the outlet orifice 11. The cylindrical side wall 39 has two catches 40 arranged at 180° from each other. As can be seen in FIG. 1, each catch 40 consists of a notch 41 made along the generating line of the wall 39 starting at its free edge, to the bottom of which notch is joined a notch 42 made in a plane at right angles to the axis of wall 39. The latter is joined to the plate 36 by a slightly frustoconical wall zone 43.

On the side remote from the wall 39 the plate 36 carries a guiding member 44, consisting of a cylindrical wall or skirt whose axis is perpendicular to that of the plate 36 and coincides with that of orifice 37. The guiding member 44 is joined at one end to the edge of the said plate 36 and has, starting from its zone of junction with the plate 36 and over a sector of the order of 80°, a reduction in its diameter forming a zone in which it has, beginning at its free edge, a slot 45 bounded by two crests arranged along the generating line of the said cylindrical wall forming the guiding member 44, and by a bottom situated in the vicinity of plate 36, and having the shape of a circular arc with the concave part turned towards the free edge of the guiding member 44.

Figure 3:
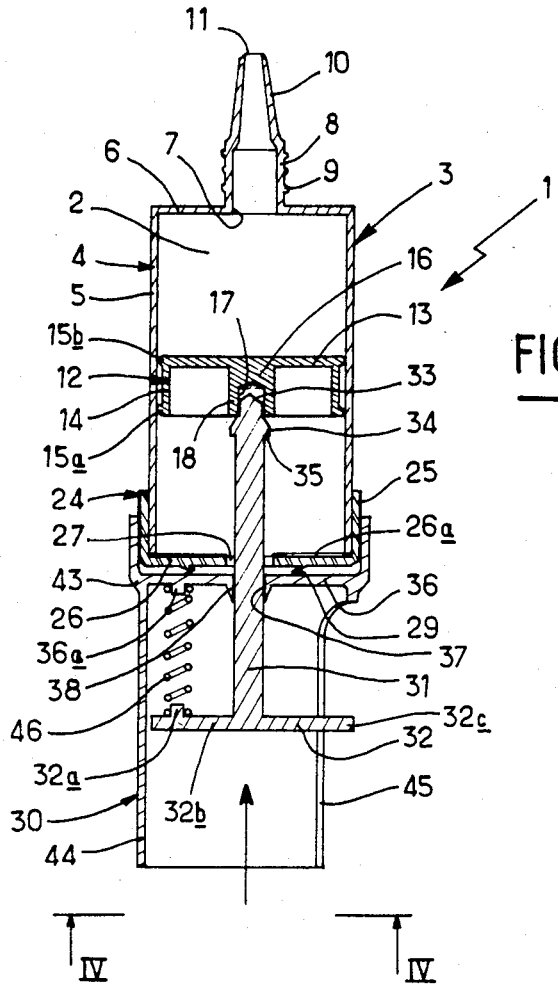
FIG. 3 is a view of the assembly of FIG. 1 in axial section along line III—III of FIG. 4, this view showing the dispenser assembly in an intermediate position of dispensing the dose of substance held in the container.

Moreover, both the plate 36 and the pusher 32 have, facing each other, a stud. These studs referenced 36*a* and 32*a* respectively as can be seen in FIG. 3, each receive the respective end of a helical spring 46. Stud 36*a* is arranged in the axial plane of the dispenser mechanism 30 forming the plane of symmetry of the slot 45 but on the opposite side of the orifice 37. In the case of stud 32*a*, this is carried by the disc 32*b* of the pusher 32 in the plane of symmetry of ring sector 32*c* and on the opposite side of the ring sector relative to the centre of the disc 32*b*. In a position for fitting the rod 31 in the fixed part of the mechanism 30, the outer rim of the sector 32*c* is located substantially on a circle centred on the axis of the guiding member 44 and having as its radius that of a straight section of the guiding member 44.

The body of the container 3 is advantageously made of polyvinyl chloride; as for the other members of assembly 1, they are advantageously made of polypropylene except for the return spring 46 and the sheet 26*a* arranged against the bottom 26 of the base 24.

The fitting and factory packaging of the unit containers 3 are carried out as follows:

For each container 3, the stoppering cap 19 is screwed onto the body 4. The assembly thus formed is turned upside down and is filled with the hair colouring product through the opening bounded by the free edge of sleeve 5 up to a level separated from this free edge by a distance equal at least to the height of the plunger 12. The plunger is then introduced into the sleeve 5 and the base 24 is added with the bottom 26 of the base covered by the sheet 26*a* forming a seal. Sealing of the base 24 is produced by passing the assembly under a high frequency sealing unit. The airtight seal 26*a* ensures that the hair colouring product in the container 3 is perfectly preserved.

The fitting of a dispenser mechanism 30 is carried out very simply in the following manner:

The spring 46 is arranged in the space bounded by the wall 44 by applying one of its ends against the stud 36*a*; the rod 31 is introduced into this space so that the stud 32*a* forming part of the pusher 32 receives the other end of the spring 46 and the rod 31 is introduced forcibly with its point 33 in the orifice 37 made in the plate 36 until the bulge 34 passes through the plate 36 and the annular bearing 35 comes to rest on the latter.

When the user wishes to dispense a dose of the hair colouring product, he or she introduces into the space bounded by the socket consisting of the side wall 39 and the plate 36, a container 3, holding this dose with its base so that each pin 28 is located in a notch 41 and reaches the bottom of the said notch. Then, the body 4 and the dispenser mechanism 30 are turned relative to each other so that the pins 28 can reach the bottom of the corresponding notches 42. Maintenance of the container 3 in this position on the dispenser mechanism 30 is ensured by the resilient lip 29 which bears against plate 36. During this operation, the point 33 of the rod 31 has passed through the aluminium seal 26*a* and has come into contact with the plunger 12 by entering the space 17 bounded by the skirt 18 of this plunger.

The cap 19 is then unscrewed and the assembly is then ready for use. By pressing on the tray 32 with the index finger of one hand, the thumb and the fingers of this hand being positioned on the body 4 of the container 3 as shown by the dot-and-dash lines in FIG. 1, it suffices to push the plunger 12 inside the body 4 to cause uniform flow of the product through the orifice 11 at will. As soon as the pressure on the pusher 32 is released, the latter returns into its loading position by virtue of the return spring 46.

The assembly just described permits direct and perfect application of the product to hair in the manner of a syringe, which permits an accurate placing of the products between locks of hair.

Naturally, the embodiment described above implies no restriction of any kind and can give rise to any desirable modifications without departing thereby from the scope of the invention as defined by the claims.

I claim:

1. An apparatus for dispensing doses of a substance having a liquid or pasty consistency, said apparatus comprising:

a receptacle defining a sealed storage volume for the substance to be dispensed; said storage volume being defined by the interior of said receptacle, a piston disposed in said interior and at one end of said receptacle, and an end wall closing an end of the receptacle opposite to said piston; said piston being displaceable in said interior from said one end to said end wall of said receptacle; said end wall including an orifice permitting the passage of the substance outside of the storage volume; said one end of the receptacle having disposed thereon a flexible sealing wall made of a fluid-tight material and a cylindrical base, wherein said sealing wall and base limit the displacement of said piston in a direction opposite to said end wall; said cylindrical base including a bottom having an orifice and carrying exteriorly resilient members and a skirt having pins extending therefrom and connecting said bottom;

a dispensing device comprising a fixed element for removably receiving said receptacle, said fixed element comprising a plate having an orifice and a cylindrical skirt having catches therein and connecting said plate, said fixed element including a guiding member connecting said plate opposite to said skirt; a movable part comprising an operating stem being disposed generally perpendicularly to said plate and passing through said orifice in said plate, said operating stem having at one end thereof means cooperating with said plate to limit the displacement of the stem in a direction extending away from said orifice of said receptacle and at the other end thereof pusher means guided by said guiding member for displacing said stem in translation relative to said orifice of said receptacle, wherein the one end of the stem cooperates with the piston and the piston is displaced upon displacement of the stem through the pusher means; and resilient means cooperating between the fixed element and the movable part to resiliently urge said stem in a direction extending away from said orifice in said fixed element;

wherein, in the assembly of the receptacle with the dispensing device, the one end of the receptacle is received in the fixed element of the dispensing device against the bias of the exteriorly resilient members on the base and the pins on the skirt of the receptacle are received in the catches of the cylindrical skirt of the fixed element, forming a bayonnet connection therebetween, to fixedly connect the receptacle to the fixed element.

2. A dispenser according to claim 1, wherein the resilient means for urging the operating stem in a direction extending away from said orifice in said fixed element comprises a spring bearing against, on the one hand, said fixed element of the dispensing device, and, on the other hand, a part of the operating stem.

3. A dispenser according to claim 1, wherein the receptacle is provided with a removable stoppering cap capable of closing said discharge orifice.

4. A dispenser according to claim 1, wherein said piston of the receptacle incorporates a cavity capable of receiving said one end of the operating stem.

5. A dispenser according to claim 1, wherein said flexible sealing wall incorporates a metal sheet sealed against the one end of the receptacle, said sheet being capable of being perforated by the operating stem.

* * * * *